US010799924B2

(12) United States Patent
Sieghart et al.

(10) Patent No.: US 10,799,924 B2
(45) Date of Patent: Oct. 13, 2020

(54) MASS FLOW REGULATION IN ROLLER DEVICES

(71) Applicant: SMS group GmbH, Düsseldorf (DE)

(72) Inventors: Jörn Sieghart, Hilden (DE); Andreas Gramer, Solingen (DE)

(73) Assignee: SMS group GmbH, Düsseldorf (DE)

( * ) Notice: Subject to any disclaimer, the term of this patent is extended or adjusted under 35 U.S.C. 154(b) by 319 days.

(21) Appl. No.: 15/665,806

(22) Filed: Aug. 1, 2017

(65) Prior Publication Data

US 2019/0039107 A1 Feb. 7, 2019

(51) Int. Cl.

| | |
|---|---|
| ***B21B 37/16*** | (2006.01) |
| ***B21B 37/46*** | (2006.01) |
| ***B21B 31/16*** | (2006.01) |
| ***B21B 37/00*** | (2006.01) |
| ***B21B 38/04*** | (2006.01) |

(52) U.S. Cl.

CPC ..... *B21B 37/16* (2013.01); *B21B 31/16* (2013.01); *B21B 37/46* (2013.01); *B21B 38/04* (2013.01); *B21B 2037/002* (2013.01); *B21B 2271/02* (2013.01); *B21B 2275/04* (2013.01); *B21B 2275/06* (2013.01)

(58) Field of Classification Search

CPC ..... B21B 37/16; B21B 37/165; B21B 37/58; B21B 37/46; B21B 38/04; B21B 38/08; B21B 38/10; B21B 38/105; B21B 31/16; B21B 2261/04; B21B 2271/02; B21B 2275/02; B21B 2275/04; B21B 2275/06

See application file for complete search history.

(56) References Cited

U.S. PATENT DOCUMENTS 4,691,546 A * 9/1987 Clegg ..... B21B 37/165 72/234

FOREIGN PATENT DOCUMENTS

| | | | | |
|---|---|---|---|---|
| DE | 2200293 A1 * | 8/1972 | ..... | B21B 37/16 |
| DE | 4243045 A1 * | 7/1993 | ..... | B21B 37/54 |
| DE | 10254178 A1 * | 6/2004 | ..... | B21B 1/22 |
| EP | 1 488 863 A2 | 12/2004 | | |
| EP | 2620233 A1 * | 7/2013 | ..... | B21B 37/16 |
| JP | 61049722 A * | 3/1986 | ..... | B21B 37/58 |
| JP | S6149772 A * | 3/1986 | ..... | B60W 10/06 |

(Continued)

OTHER PUBLICATIONS

Machine translation of DE-4243045-A1 (Year: 1993).*

(Continued)

*Primary Examiner* — Teresa M Ekiert
*Assistant Examiner* — Sarkis A Aktavoukian
(74) *Attorney, Agent, or Firm* — Maier & Maier, PLLC

(57) ABSTRACT

A method for controlling a roller line, preferably a cold roller line, which has one or more roller stands each with two working rollers, which form a roller gap, through which a roller band is transportable. One or both working rollers can shift relative to the other, so that the roller gap is adjustable. The method includes making available a reference speed, which is a parameter for controlling the roller line, measurement of speed of the roller band before the inlet into the roller gap, measurement of the thickness of the roller band before the inlet into the roller gap, and adjustment of the roller gap of one or more roller frames in the roller line on the basis of measured speed and thickness before the inlet into the roller gap as well as the reference speed.

5 Claims, 2 Drawing Sheets

(56) References Cited

FOREIGN PATENT DOCUMENTS

| | | | |
|---|---|---|---|
| JP | H04-46622 | A | 2/1992 |
| WO | 2011/032888 | A1 | 3/2011 |

OTHER PUBLICATIONS

Machine translation of DE-10254178-A1 (Year: 2004).*
Machine translation of DE-2200293-A1 (Year: 1972).*
Machine translation of EP-2620233-A1 (Year: 2013).*
Machine Translation of JP-61049722-A, Iwato et al., Publication Year 1986, Total pp. 6. (Year: 2020).*
Machine Translation of JP-S6149772-A, Fumio et al., Publication Year 1986, Total pp. 6 (Year: 2020).*
European Search Report dated Dec. 19, 2018, in connection with corresponding EP Application No. 18181081.3 (6 pgs., including English translation).
European Office Action dated Jan. 18, 2019, in connection with corresponding EP Application No. 18181081.3 (10 pgs., including English translation).

* cited by examiner

MASS FLOW REGULATION IN ROLLER DEVICES

TECHNICAL FIELD

The invention relates to a method for control of a roller line, preferably a cold roller line, which has one or more roller stands each with two working rollers, which form a roller gap, through which a roller strip is transportable. The invention further relates to a control device and a roller line.

BACKGROUND OF THE INVENTION

With roller devices, especially cold roller devices, the thickness of the roller band during transport through the roller gap can be governed by means of mass flow regulation, in which, from the measured intake-side thickness and the measured intake and outflow speeds, the thickness of the rolled stock after running through the roller gap is computed. True, it is often difficult to measure speed at the outlet of the roller stand. Thus, with a tandem line, i.e. a roller line with multiple roller stands placed one behind the other, measurement of speed at the outlet of the first roller stand can be difficult, perhaps due to the slip between the rolled stock and measuring roller unit, emulsion or oil on the measured stock, vapor or lack of space, for example when a laser is used for the measurement.

It is known to dispense with direct speed measurement at the outlet of the roller gap, and instead, from various de facto dimensions of the roller line, perhaps of the stand speed or the winch speed, to infer the outlet speed. Thus, DE 10 2009 012 028 A1 describes a method for operating a roller line in which the cutlet speed of the roller band behind the roller gap can be reproduced by computing with the aid of the tangential speed of working rollers. For this purpose, sensors are required to determine the de facto dimensions as well as electronics for computing the outlet speed.

SUMMARY OF THE INVENTION

One object of the invention is to make available a method and a device for controlling a roller line, preferably a cold roller line, which makes possible high control precision while the roller line undergoes structural simplification.

For definition of relative positions, designations like "before," "after," "intake side," "outlet side," etc. are used. These are to be understood in relation to the transport direction of the roller band.

The invention-specific method serves for controlling or regulating (here used as synonyms) of a roller line, preferably a cold roller line. The roller line has one or more roller stands, each with two working rollers which form a roller gap through which a roller band is transportable. The roller band is a band-shaped metallic material, perhaps made of steel or a non-ferrous metal which is to be subjected to a single- or multi-stage rolling process through the working rollers. One or both working rollers of the roller stand in question are able to travel relative to each other, so that the roller gap, i.e. the distance between the two working rollers, is adjustable.

For controlling the roller line, according to the invention, first a reference speed is made available, which is a parameter for controlling the roller line. The reference speed can for example be a target speed at which the roller band is to be transported through the miler line, perhaps when, after startup, it is in a stationary or quasi-stationary state. According to another embodiment, the reference speed can be a speed parameter with which a roller, preferably a working roller, return pulley or winch, is guided in the roller line. The reference speed can also be another parameter as long as it is not determined by measuring the speed at which the roller band exits the roller gap. The reference speed can for example be determined in advance, it can be constant or a function of time.

According to the invention, the speed and thickness of the roller band are measured before insertion in the roller gap. The roller gap of the roller stand in question, or of one or more other stands in the roller line, is adjusted on the basis of the measured speed and thickness before intake into the roller gap and the reference speed.

Accordingly, the control is not computed while making allowance for any measured outlet-side band speed or from de facto parameters of the roller line, but rather from using the reference speed, i.e. of a parameter for guidance of the roller line. Especially, for computing the mass flow thickness, i.e., the product of the band speed and band thickness, which with running through the roller stands is a conservation quantity (in the inlet of the roller stand, the product of the band speed and band thickness corresponds to that in the outlet of the roller stand), the reference speed in the outlet is used. Costs can be saved which otherwise would accrue to setup, installation, maintenance, etc. of the corresponding sensors and electronic devices. The control is less impaired by measurement error, which especially can appear with a speed measurement at the outlet of the first roller stand, perhaps due to slip between the roller stock and measurement roller unit, emulsion or oil on the measured stock, vapor or lack of space, for example if a laser is used for measurement. The reliability of thickness regulation is increased, which in turn has an effect on the quality of the rolled product to be manufactured. Especially with facilities having difficult installation situations, the described control makes possible regulation of thickness with high dynamics and direct reaction in the roller gap.

Preferably the difference between the de facto thickness of the roller band at the outlet of the roller line and the target thickness is leveled by means of a proportional-integral (PI) regulation or proportional-integral-derivative (PID) regulation, in order to obtain the sought-after band thickness in a reliable manner and with high precision.

Preferably, along with the reference speed, a reference band thickness is provided, which is a parameter for regulating the roller line. Thus, the reference band thickness can for example be that target thickness which is striven for the roller band after passed through the roller line, especially if, after startup, the roller line is in a stationary or quasi-stationary state. For example, the reference band thickness can be determined in advance, it can be constant or a function of time or a function of the length of the roller stock. For adjustment of the roller gasp, preferably a thickness deviation of the roller band is computed while allowing for the reference speed and reference band thickness. Specifically, the computed thickness deviation is the difference between the intake-side mass flow thickness, which is for example computed with the reference speed divisor, and the reference band thickness. Preferably the outlet-side band thickness is measured again, a measured thickness deviation is derived from this, and the measured thickness deviation is compared with the computed thickness deviation.

Preferably the reference speed is determined for computation of the thickness deviation of the roller band, while allowing for one or more correction values from a regulation of tension, band thickness, one or more driving torques and/or the speed guidance, to improve regulation precision.

For the same reason, according to a preferred embodiment, the reference speed is computed for computation of the thickness deviation of the roller band from a target speed and while allowing for one or more additional quantities, such as target thickness and/or reduction in roller roughness and/or roller power and/or target tension.

Especially preferred, the additional quantity is a forward slip, which for example can be computed, assumed or determined in another manner. The forward slip, which is linked with the flow neutral point position, is defined as the relationship of linear speed of the roller, such as a working roller, return pulley, etc. to the outlet speed of the roller band. Or more precisely: forward slip [%]=(speed of the roller band at the outlet [m/s]/linear speed of roller [m/s])−1*100. The forward slip can be constant over the rolling process or be a function of time or a function of the reference speed.

Preferably the forward slip is computed, wherein the computation of forward slip is at least a non-measured quantity and/or at least a measured quantity. Thus, forward slip is preferably computed while allowing for various states of the facility before the start of, and/or during the rolling process, through which regulation precision and reaction of the roller gap during thickness regulation can be guaranteed even without measurement of the outlet-side band speed.

According to another embodiment, the mass flow is regulated for one or more roller stands, but without measurement and tracking of the outlet-side thickness and speed, i.e. exclusively with measurement of the thickness and speed on the inlet side. For this, the roller line has several roller stands, with the thickness of the roller band being measured behind the last roller stand, and for adjustment of the roller gap of one or more roller stands (especially for determination of the mass flow thickness at one or more roller stands), the reference band thickness is used, so that measurement of the outlet-side band thickness can be dispensed with in this regard. For example, for a roller line with multiple roller stands, in addition to dispensing with an outlet-side speed measurement in the first roller stand, the thickness measurement can also be dispensed with on the outlet side. In this case, the thickness regulation in the last roller stand can stabilize the thickness offset, to reach the desired target thickness. All dynamic disturbances such as disturbances in inlet thickness and/or deviations in hardness, can already be regulated from the first roller stand according to a version of this embodiment. Although a measurement of thickness after the first roller stand is not absolutely necessary in this version, nonetheless an appropriate thickness measurement device can be provided, to provide a fallback option in case the inlet-side thickness measurement fails.

The invention-specific device for controlling a roller line, preferably a cold roller line, is set up to implement a method as described above. Thus, the control can perhaps be implemented with the aid of an electronic circuit. The control can exist in the form of software, which, if it is used on a computer, makes the appropriate computations and steps for controlling the roller line.

The control described is particularly applicable to operation of cold rolling lines for processing metal strips. The roller line can be designed as a reversing unit with directional change in band guidance. However, the invention can also be implemented in other areas, as long as they have to do with a rolling process in which a desired thickness of the roller stock is to be adjusted automatically.

Additional advantages and features of the present invention are evident from the following specification of preferred embodiments. The features described there can be implemented in isolation or in combination with one or more of the features described above, as long as they do not contradict the features. The following specification of preferred embodiments is done with reference to the accompanying drawings.

DETAILED DESCRIPTION

In what follows, preferred embodiments are described, employing the figures. With this, similar or identically acting elements are provided with identical reference symbols, and in part a repeated description of these elements is dispensed with, to avoid redundancies.

Figure 1:
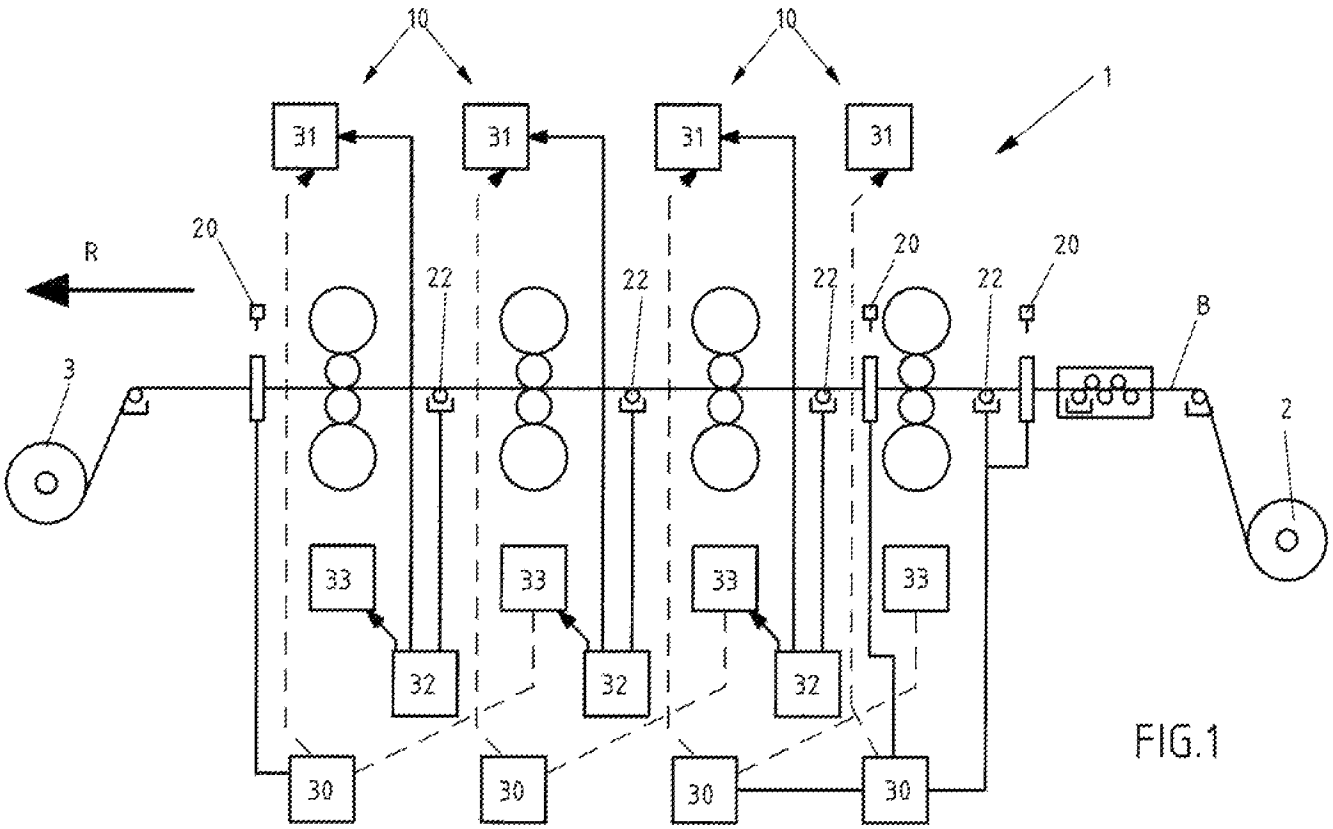
FIG. 1 is a schematic depiction of a tandem line with four roller stands situated one after the other.

FIG. 1 is a schematic depiction of a tandem line or roller line 1 with four roller stands 10 situated one behind the other, preferably for a cold roller line. Roller line 1 in the current example has an unwinding winch 2 and a takeup winch 3. A roller band or roller stock B is fed to roller stands 10 in transport direction R, if necessary via return pulleys, and after passing roller stands 10, i.e. after completion of the roller processing, is wound up by takeup winch 3. The feeding and removal of roller band B via winches 2 and 3, is only an example; roller band B can also be brought to roller stands 10 by another means and be removed for further processing, for transport, etc.

Figure 2:
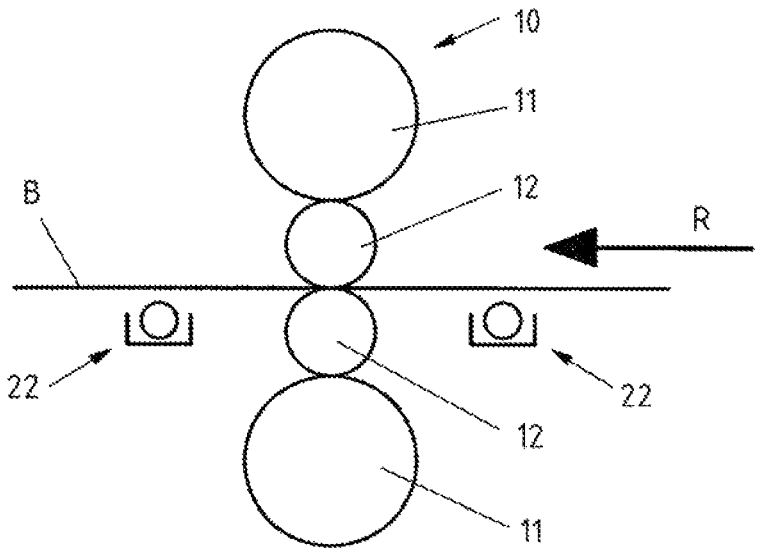
FIG. 2 is a schematic depiction of a roller stand with two supporting rollers and two working rollers.

To distinguish the roller stands 10, they are given consecutive numbers in transport direction R of roller band B, i.e. in the FIG. 1 view, from right to left. Each roller stand 10 has two support rollers 11 and two working rollers 12. It should, however, be noted that the method depicted can be implemented and is suitable for all stand arrangements with two or more rollers per stand. For the sake of clarity, reference symbols 11 and 12 are not drawn in in FIG. 1, but they are revealed in FIG. 2, in which one roller stand 10 is chosen and shown in an enlarged manner. One working roller 12 is in contact with each support roller 11. Between the two working rollers 12 there is a roller gap, through which roller band B is guided. The roller gap is adjustable, in that one or both of the working rollers 12 that form the roller gap is adjustable relative to each other. Working rollers 12 and/or support rollers 11 are for example driven by one or more electric motors (not shown in the figures) in rotating fashion, if necessary by interposing a drive, a clutch, a brake, etc. For this purpose, the roller stands 10 each have a drive controller 33.

Before first roller stand 10, before second and after fourth roller stand 10, a thickness measuring device 20 is situated, which is installed for measurement of the thickness of roller band B at the particular position. In the present embodiment, to each roller stand 10, a thickness controller 30 is assigned, which communicates with a gap controller 31 for adjusting the gap between the particular working rollers 12. Additionally, in the present example, before each roller stand 10 a tension regulator 22 is situated, which has an actuator to alter the adjustment of roller band B relative to roller stand 10. An adjustment alteration is used to regulate the inlet-side tension of roller band B. A change in tension is to be equated with a change in speed of roller band B. The tension regulators 22 of second to fourth roller stands 10 each have a tension controller 32 for setting the adjustment.

Possible communication paths between controllers 30, 31, 32, 33 and the pertinent actuators, motors, etc. are schematically drawn in FIG. 1. The communication can occur in physical or in wireless fashion. Even if controllers 30, 31, 32, 33 in FIG. 1 are depicted separately, they naturally can be configured to be integrated or perhaps as part of a central control. The designation of "device" in this connection does not necessarily mean a mechanical entity, because controllers 30, 31, 32, 33 can also be implemented using software which controls roller line 1, if it is implemented on a computer.

The gap of the particular roller stand 10 is adjusted via a mass flow control. The starting point is a conservation quantity, the product of the band speed and the band thickness shifted in the roller gap, which is designated as a "mass flow quantity" and is altered with passage of roller band B through roller stand 10 or example analogous to an inlet-side thickness disturbance or alteration of other process quantities such as band strength, gap friction and/or band speed.

$$v_i(t)*h_i(t)=v_{i-1}(t)*h_{i-1}(t)$$

With this, $v_i(t)$ designates the band speed at the outlet of roller stand 10 (equal to band speed at the inlet of any following roller stand 10) as a function of time. $h_i(t)$ designates the measured band thickness at the outlet of roller stand 10 (equal to the roller band thickness at the inlet of any following roller stand 10) as a function of time. $v_{i-1}(t)$ designates the band speed measured on the inlet side about roller stand 10 as a function of time, and $h_i(t)$ designates the measured band thickness on the inlet side about roller stand 10. The equation is valid for all roller stands 10 in a roller line 1, the "i" in the designations is a whole number for consecutive numbering of the individual roller stands 10.

If an outlet-side reference band thickness is designated by $h_{iR}(t)$ and $h_{iDev}(t)$ designates the outlet-side band thickness deviation, i.e., $$h_i(t)=h_{iR}(t)+h_{iDev}(t)$$

there follows:

$$h_{iDev}(t)=\frac{h_{i-1}(t)*v_{i-1}(t)}{v_i(t)}-h_{iR}$$

The reference band thickness is a parameter for guidance of the roller line. Thus, the reference band thickness can be that target thickness that is striven for the roller band after passage of the roller line, especially if the roller line, after the startup, is in a stationary or quasi-stationary state. The reference band thickness can for example be set in advance, it can be constant or a function of time, and/or of the band length.

Now instead of measuring $v_i(t)$ conventionally, such as by means of a laser, or from de facto quantities of roller line 1, such as computing winch speed or working roller speed, for computation of the mass flow thickness a reference speed at the outlet $v_{iR}(t)$ is used. This is possible because the effects of an adjustment change of roller band B relative to roller stand 10 through tension regulator 22 can be neglected. The change in outlet speed merely contains the forward slip change evoked by the adjustment change, which is very small in relation to the absolute change, especially in the speed ranges in which a mass flow control is carried out.

The reference speed $v_{iR}(t)$ can therefore be a speed parameter by which roller line 1 is controlled. Therefore, measurement or computation of a speed while using a measured quantity that corresponds to the speed at the outlet of the roller gap, can be dispensed with. The reference speed $v_{iR}(t)$ can for example be a target speed at which roller band B is to be transported through roller line 1, perhaps if the roller line 1 after startup is in a stationary or quasi-stationary state. The reference speed $v_{iR}(t)$ can for example also be a speed parameter by which a roller, preferably working roller 12, or a winch, is guided in roller line 1. The reference speed can be set in advance, it can be constant or a function of time or of the band length. The reference speed can, but must not, contain one or more correction values from other control systems. These correction values can for example consist of or be computed from control corrections of tension, band thickness and/or of speed guidance. These correction values can, for example, consist of or be computed from control corrections of tension, band thickness and/or of the speed guidance.

From this follows the computed band thickness deviation $h_{iDevCale}(t)$ in the i'th roller stand 10, $$h_{iDevCalc}(t)=\frac{h_{iTrk-1}(t)*v_{i-1}(t)}{v_{iR}(t)}-h_{iR}$$

Where $h_{iTrk-1}(t)$ designates the inlet-side (on the i'th roller stand 10) measured band thickness of roller band B.

Roller band 10 with the band thickness deviation thus computed, is then transferred or transported to the outlet-side thickness measuring device 20. This computed hand thickness deviation, transported on to the thickness measurement device 20 at the outlet is compared with the thickness deviation measured at the outlet. The error is tracked, this being done likewise with the reference speed $v_{iR}(t)$.

In this way, thickness errors can be tracked, and the target thickness at the end of roller line 1 is reached. The difference between the de facto thickness of roller band 10 at the end of roller line 1 and the desired thickness can be stabilized for example by a PI controller or PID controller, as also by a feedback via a filter unit.

According to another embodiment, the mass flow control can also be run without tracking of the outlet-side thickness, i.e., exclusively with the inlet-side thickness and speed measurement as per:

$$h_{iDevCalc}(t)=\frac{h_{iTrk-1}(t)*v_{i-1}(t)}{v_{iR}(t)}-h_{iR}$$

With this, in a roller line 1 with multiple roller stands 10 (a tandem line), in addition to doing away with an outlet-side speed measurement in the first roller stand 10, thickness measurement can also be dispensed with on the outlet side. In this case the thickness control in the last roller stand 10 can stabilize the thickness offset, to be able to come to the desired target thickness. All dynamic disturbances, such as irregularities in inlet thickness and/or variations in hardness, can be stabilized already from the first roller stand 10 according to a variant of this embodiment. Although a measurement of thickness after the first roller stand 10 is not absolutely necessary in this version, nonetheless an appropriate thickness measurement device can be provided, to provide a fallback option in case the inlet-side thickness measurement fails.

Through the embodiments depicted for mass flow thickness regulation, measurement or computation of speed of toiler band B at the outlet of one or more roller stands 10 can be dispensed with. Costs can thereby be saved which otherwise would accrue to setup, installation, maintenance, etc. of the corresponding sensors and electronic devices. The control is less impaired by measurement error, which especially can appear with a speed measurement at the outlet of first roller stand 10, perhaps due to slip between the roller stock and measurement roller unit, emulsion or oil on the measured stock, vapor or lack of space, for example if a laser is used for measurement. The reliability of thickness regulation is increased, which in turn has an effect on the quality of the rolled product to be manufactured. Especially with facilities having difficult installation situations, the described control makes possible regulation of thickness with high dynamics and direct reaction in the roller gap.

The control or regulation is especially preferably applicable for cold rolling lines for rolling band-shaped metallic materials, especially metallic bands of steel or nonferrous metals (NF) metals.

If applicable, all the individual features that are described in the embodiments, can be combined with each other and/or exchanged, without departing from the scope of the invention.

LIST OF REFERENCE SYMBOLS

1 Roller line
2 Unwinding winch
3 Takeup winch
10 Roller stand
11 Support roller
12 Working roller
20 Thickness measuring device
22 Tension regulator
30 Thickness controller
31 Gap controller
32 Tension controller
33 Drive controller
B Roller band
R Transport direction

The invention claimed is:

1. A method for controlling a roller line, which has one or more roller stands each with two working rollers, which form a roller gap, through which a roller band is transportable, wherein one or both working rollers can shift relative to the other, so that the roller gap is adjustable, wherein the method comprises controlling the roller line by performing the steps of:

determining a reference speed, which is a parameter for controlling the roller line;

measuring a speed of the roller band before an inlet into a first roller gap;

measuring a thickness of the roller band before the inlet into the first roller gap; and adjusting one or more roller gaps of one or more roller stands in the roller line on the basis of the measured speed and the thickness before the inlet into the first roller gap as well as the reference speed, wherein the controlling of the roller line is carried out without taking into account any measured or calculated outlet side band speed at a last roller stand of the one or more roller stands, and further comprising:

determining a reference band thickness, which is a parameter for controlling the roller line, and before the adjusting of the one or more roller gaps, computing a thickness deviation of the roller band as follows:

$$h_{iDevCalc}(t) = \frac{h_{iTrk-1}(t) * v_{i-1}(t)}{v_{iR}(t)} - h_{iR}$$

wherein:

$h_{iDevCalc}(t)$=the thickness deviation of the roller band,
$h_{iTrk-1}(t)$=the thickness at an inlet of any roller stand,
$v_{i-1}(t)$=the measured speed,
$v_{iR}(t)$=the reference speed, and
$h_{iR}$=the reference band thickness.

2. The method of claim 1, wherein the reference speed corresponds to a target speed at which the roller band is to be transported through the roller line, or is a speed parameter with which one or more rollers, a return pulley or a winch, are controlled in the roller line.

3. The method of claim 1, further comprising:

measuring an outlet-side band thickness at the one or more roller stands, for each roller stand in the one or more roller stands, determining a measured thickness deviation based on an inlet-side band thickness and the outlet-side band thickness across said each roller stand, and comparing the measured thickness deviation with the computed thickness deviation.

4. The method of claim 1, wherein the reference band thickness is a target thickness upon exiting the roller line.

5. The method of claim 1, wherein the thickness of the roller band at the inlet of one roller stand is measured and the reference band thickness is used for adjusting the roller gap of one or more subsequent roller stands of the one or more roller stands in a transport direction of the roller line.

* * * * *